US005896681A

United States Patent [19]

Lin

[11] Patent Number: 5,896,681

[45] Date of Patent: Apr. 27, 1999

[54] SOLE PAD WITH SHOCK-ABSORBING AND MASSAGING EFFECT

[75] Inventor: Chin-Yi Lin, Taichung Hsien, Taiwan

[73] Assignee: Chan Jang Plastics Co., Ltd., Taichung Hsien, Taiwan

[21] Appl. No.: 08/795,665

[22] Filed: Feb. 6, 1997

[51] Int. Cl.[6] ..... A43B 13/20; A43B 13/40; A43B 21/26

[52] U.S. Cl. ..... 36/28; 36/29; 36/35 R; 36/35 B; 36/153

[58] Field of Search ..... 36/28, 29, 35 R, 36/35 B, 141, 153

[56] References Cited

U.S. PATENT DOCUMENTS 4,458,430 7/1984 Peterson ..... 36/28

FOREIGN PATENT DOCUMENTS 62622 10/1982 European Pat. Off. ..... 36/28
WO 91/16831 11/1991 WIPO ..... 36/29
WO 93/12685 7/1993 WIPO ..... 36/29
WO 93/18677 9/1993 WIPO ..... 36/28

*Primary Examiner*—Paul T. Sewell
*Assistant Examiner*—Anthony Stashick
*Attorney, Agent, or Firm*—Bacon & Thomas

[57] ABSTRACT

A sole pad with shock-absorbing and massaging effects is provided with, on the underside thereof, a mounting recess including a first and second receiving cavities that are connected to each other by a connection groove. A pressure transmitter has a first massaging ball and a second massaging ball filled with liquid and in communication with each other by way of a tubular portion. The pressure transmitter is securely housed in the mounting recess. The first and second receiving cavities have respectively a through hole so as to permit the massaging balls of the pressure transmitter to outextend the surface of the sole pad for contact with a wearer's foot. Liquid filled in the pressure transmitter can move between the first and second massaging balls by way of the tubular portion when the wearer's foot exerts unbalanced pressure on the sole pad in walking so as to effect shock absorbing and massaging purpose at the same time.

1 Claim, 3 Drawing Sheets

SOLE PAD WITH SHOCK-ABSORBING AND MASSAGING EFFECT

BACKGROUND OF THE INVENTION

The present invention relates to a sole pad with a shock-absorbing and massaging effects. On the underside of the sole pad is provided with a mounting recess including first and second receiving cavities that are connected to each other by a connect groove. A pressure transmitter has a first massaging ball and a second massaging ball filled with liquid and in communication with each other by way of a tubular portion. The massaging balls of the pressure transmitter are produced in the same shape as the first and second receiving cavities with the tubular portion in the form of the connection groove so that the pressure transmitter can be securely housed in the first and second cavities and the connection groove. The first and second receiving cavities have respectively a through hole so as to permit the massaging balls filled with liquid to outextend the surface of the sole pad and to contact with the bottom of a wearer's foot. Liquid filled in the pressure transmitter can move between the first and second massaging balls by way of the tubular portion when the wearer's foot exerts unbalanced pressure on the sole pad in walking so as to effect shock absorbing and massaging purpose at the same time.

Conventional sole pads are made in various materials and have different thickness, softness and functions mainly for the protection of people's feet from blisters caused by constant friction in walking. But the quality and structure of a sole pad can have direct effect on the protection of a wearer's feet.

SUMMARY OF THE INVENTION

The primary object of the present invention is to provide a sole pad put on top of a shoe sole and provided with a pair of soft massaging balls filled with liquid and communicating with each other by way of a tubular portion so that the filled liquid flow from one massaging ball to the other when unbalanced pressures exerted by a foot are applied to the balls, effecting massaging to the feet and helping the blood circulation of the feet in addition.

Another object of the present invention is to provide a sole pad equipped with a liquid filled pressure transmitter in which liquid can internally flow from one soft massaging ball to the other as a result of unbalanced pressures produced in running and jumping and exerted on the soft and flexible massaging balls so as to effect shock absorbing in addition.

DETAILED DESCRIPTION OF THE PREFERRED EMBODIMENT

Figure 1:
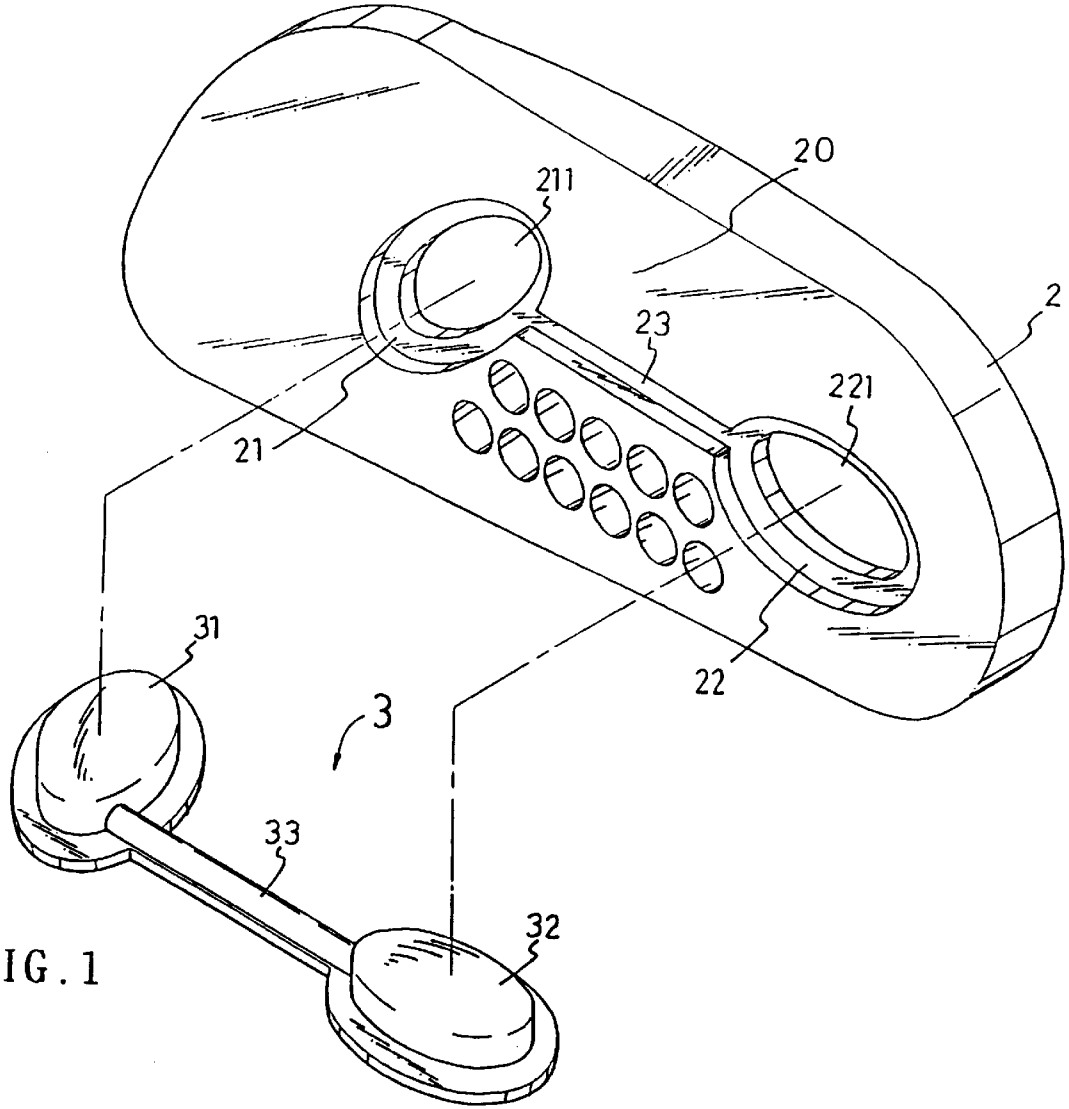
FIG. 1 is a diagram showing the exploded components of the present invention.

Referring to FIG. 1, the sole pad with shock-absorbing and massaging effects is comprised of a sole pad 2 and a pressure transmitter 3.

The sole pad 2 is provided with a mounting recess 20 on the underside thereof, including a slantly disposed first receiving cavity 21 connected to a longitudinally placed second receiving cavity 22 by a connection groove 23. The first and second receiving cavities 21, 22 are respectively placed at the center and heel of the sole pad 2. The first receiving cavity 21 has a through hole 211 and so does the second receiving cavity 22 a through hole 221.

The pressure transmitter 3 filled with liquid internally and housed in the mounting recess 20 of the sole pad 2 is made up of a first soft massaging ball 31 and a second massaging ball 32 that are filled with liquid and communicates with each other by way of tubular portion 33.

Figure 2:
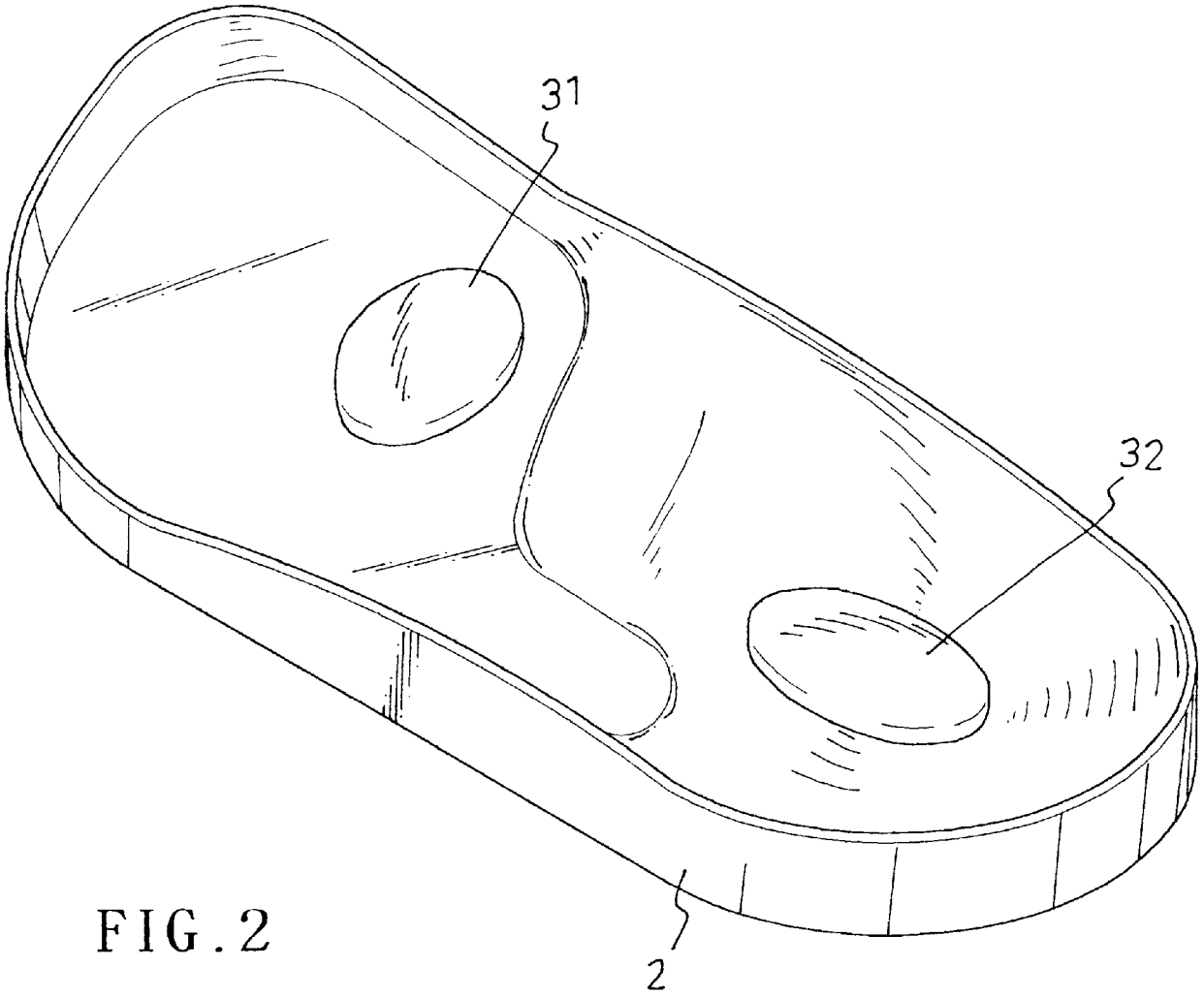
FIG. 2 is a perspective diagram of the present invention.
Figure 3A:
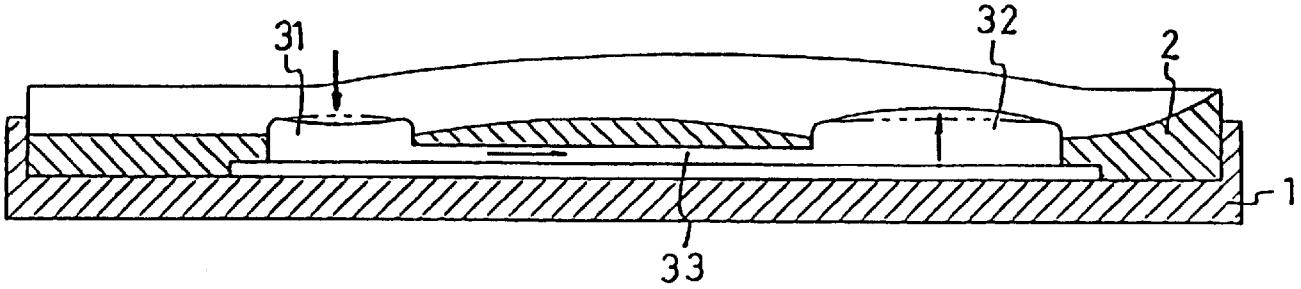
FIG. 3A and 3B are cross-sectional view of the present invention.
Figure 3B:
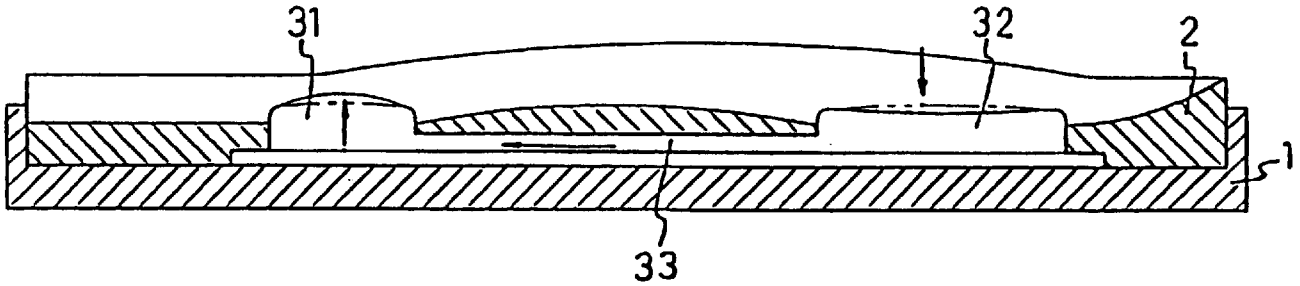

Referring to FIG. 2, in assembly, the pressure transmitter 3 is engaged with the mounting recess 20 with the first and second massaging balls 31, 32 sticking out of the through holes 211, 221 of the first and second receiving cavities 21, 22. The assembled sole pad 2 is then placed on top of a shoe sole 1, as shown in FIG. 3.

In practical use, the first and second soft massaging balls 31, 32 filled with liquid and communicating with each other, are flexibly deformed due to unbalanced pressure exerted thereon, forcing liquid to be shifted between the two massaging balls 31, 32 by way of the tubular portion 33 in correspondence to the pressures exerted by a foot on the sole pad 2 whereby shock absorbing and massaging effects can be achieved accordingly.

I claim:

1. A massaging sole pad for a shoe having a shoe sole, the sole pad comprising:

a) a sole pad with a bottom surface facing the shoe sole the sole pad having first and second spaced apart holes extending completely through a thickness of the sole pad and a groove in the bottom surface extending between the first and second holes; and b) a pressure transmitter having liquid therein, the pressure transmitter having first and second massaging balls connected by a tubular portion such that the liquid may pass from one massaging ball to the other through the tubular portion, each massaging ball having an upper surface, the pressure transmitter located in the sole pad such that the first and second massaging balls are located in the first and second holes, respectively, with the upper surfaces of the massaging balls above an upper surface of the sole pad, and the tubular portion located in the groove in the bottom surface of the sole pad whereby the tubular portion is between the sole pad and the shoe sole.

* * * * *